US006368074B1

(12) United States Patent
Yamamoto et al.

(10) Patent No.: US 6,368,074 B1
(45) Date of Patent: Apr. 9, 2002

(54) PISTON TYPE COMPRESSOR

(75) Inventors: Shinya Yamamoto; Yoshiyuki Nakane, both of Kariya (JP)

(73) Assignee: Kabushiki Kaisha Toyoda Jidoshokki, Kariya (JP)

( * ) Notice: Subject to any disclaimer, the term of this patent is extended or adjusted under 35 U.S.C. 154(b) by 0 days.

(21) Appl. No.: 09/678,435

(22) Filed: Oct. 3, 2000

(30) Foreign Application Priority Data

Oct. 4, 1999 (JP) ..... 11-282530

(51) Int. Cl.[7] ..... F04B 1/12
(52) U.S. Cl. ..... 417/269
(58) Field of Search ..... 417/269, 415, 417/222.2; 92/71

(56) References Cited

U.S. PATENT DOCUMENTS

| | | | | |
|---|---|---|---|---|
| 4,061,443 A | | 12/1977 | Black et al. | |
| 4,105,370 A | | 8/1978 | Brucken et al. | |
| 5,704,769 A | * | 1/1998 | Michiyuki et al. | 417/269 |
| 5,947,698 A | * | 9/1999 | Ikeda et al. | 417/269 |
| 6,077,049 A | * | 6/2000 | Nakamura et al. | 417/269 |
| 6,126,405 A | * | 10/2000 | Kawaguchi et al. | 417/222.2 |
| 6,126,406 A | * | 10/2000 | Kawaguchi et al. | 417/222.2 |
| 6,158,974 A | * | 12/2000 | Tarutani et al. | 417/269 |
| 6,227,812 B1 | * | 5/2001 | Kawaguchi et al. | 417/222.2 |
| 6,231,315 B1 | * | 5/2001 | Ikeda et al. | 417/269 |

FOREIGN PATENT DOCUMENTS

| | | |
|---|---|---|
| JP | 5-187356 | 7/1993 |
| JP | A-5-231311 | 9/1993 |
| JP | 7-119635 | 5/1995 |

* cited by examiner

*Primary Examiner*—Teresa Walberg
*Assistant Examiner*—Vinod D. Patel
(74) *Attorney, Agent, or Firm*—Woodcock Washburn LLP

(57) ABSTRACT

The piston type compressor of the present invention prevents high pressure refrigerant from leaking out of the compressor through the end face of the cylinder block and also prevents the degradation of the performance of the compressor due to the leakage of the refrigerant gas. The cylindrical wall (3*a*), which is placed radially outside the front coupling surface (F) formed by the front end face of the cylinder block (1) and the rear end face of the front housing (2), and the rear coupling surface (R) formed by the rear end face of the cylinder block (1) and the front end face of the rear housing (3), is formed integrally with the rear housing (3) and encloses the front coupling surface (F) and the rear coupling surface (R). The front end face of the cylindrical wall (3*a*) and the rear end face (20*a*) of the motor housing (20) are coupled together and a hermetic space is formed internally. The sealing ability at the front coupling surface (F) and the rear coupling surface (R) is improved and the high pressure refrigerant can be prevented from leaking out of the compressor through the front coupling surface (F) and the rear coupling surface (R).

13 Claims, 3 Drawing Sheets

PISTON TYPE COMPRESSOR

BACKGROUND OF THE INVENTION

1. Field of the Invention

The present invention relates to a piston type compressor. More particularly, the present invention relates to a piston type compressor in which the quality of the seal at the end face of a cylinder block has been improved. The piston type compressor of the present invention can be preferably used for an air conditioner in a vehicle.

2. Description of the Related Art

A conventional piston type compressor used for an air conditioner in a vehicle (referred to simply as a "compressor" hereinafter) comprises a cylinder block in which a cylinder bore is formed internally, a front housing that supports a drive shaft while allowing a rotational motion and is coupled to a front of the cylinder block at a front coupling surface, which is formed by a rear end face of the front housing and a front end face of the cylinder block and has an outer periphery, and a rear housing that forms a suction chamber and a discharge chamber internally and is coupled to the rear of the cylinder block at a rear coupling surface, which is formed by a front end face of the rear housing and a rear end face of the cylinder block and has an outer periphery.

In a compressor of this type, by means of a reciprocating motion of pistons in cylinder bores, refrigerant at low pressure, which has been fed back to the suction chamber from an external refrigerating circuit, is sucked into the cylinder bores and compressed and then discharged into the discharge chamber as high pressure refrigerant.

Such a compressor, however, has a problem that its performance is degraded due to the loss of the refrigerant gas to be compressed, if the high pressure refrigerant gas leaks out of the compressor through the cylinder block end face when the refrigerant gas at low pressure is compressed in the cylinder bore, or when the compressed high pressure refrigerant gas is discharged from the cylinder bore to the discharge chamber.

The above-mentioned problem becomes more conspicuous particularly in an air conditioner in which the pressure of the high-pressure side (discharge pressure of the compressor) of a closed circuit, a constituent part of the air conditioner, reaches a supercritical pressure of the refrigerant. (Such an air conditioner will be referred to as an "air conditioner with a supercritical cycle" hereinafter).

In a compressor of an air conditioner with a supercritical cycle, refrigerant gas is compressed beyond its critical pressure For example, when carbon dioxide that has a critical pressure of about 7.35 MPa is used as refrigerant, it will be compressed to a pressure of about 10 MPa. On the other hand, in an air conditioner that uses refrigerant of chlorofluorocarbon type, in which both the discharge pressure and the suction pressure are below the critical pressure of the refrigerant during operation (such an air conditioner will be referred to as an "air conditioner with subcritical cycle" hereinafter), the discharge pressure of the compressor is about 1 to 3 MPa, and it can be concluded that the discharge pressure of a compressor in an air conditioner with a supercritical cycle is by far higher than that in an air conditioner with subcritical cycle. In a compressor of an air conditioner with supercritical cycle, therefore, the high pressure refrigerant may leak easily through the end face of the cylinder block because of the high pressure.

Particularly when carbon dioxide is adopted as refrigerant, it is difficult to achieve a sufficient sealing performance because of the high permeability of the carbon dioxide through rubber, even though O-rings are used at the end face of the cylinder block for sealing.

SUMMARY OF THE INVENTION

With these above-mentioned problems being taken into account, the present invention has been developed. The technical purpose of the present invention is to prevent the degradation of the performance of a compressor due to the leakage of refrigerant gas by preventing the high pressure refrigerant from leaking out of the compressor through the end face of the cylinder block.

The piston type compressor in the first aspect of the present invention comprises a cylinder block which has cylinder bores formed therein, a rear end face and a front end face, a front housing that has a rear end face, supports a drive shaft while allowing a rotational motion and is coupled to a front of the cylinder block at a front coupling surface, which is formed by the rear end face of the front housing and the front end face of the cylinder block and has an outer periphery, and a rear housing that has a front end face and forms at least a discharge chamber internally and is coupled to a rear of the cylinder block at a rear coupling surface, which is formed by the front end face of the rear housing and the rear end face of the cylinder block and has an outer periphery, wherein: refrigerant is compressed and the high pressure refrigerant is discharged to the discharge chamber by the reciprocating motion of pistons in the cylinder bores by driving the drive shaft; and at least one of the front housing and the rear housing includes a cylindrical wall that is placed radially outside and encloses the front coupling surface and the rear coupling surface.

In this compressor, the front coupling surface, which is formed by the front end face of the cylinder block and the rear end face of the front housing, and the rear coupling surface, which is formed by the rear end face of the cylinder block and the front end face of the rear housing are enclosed by the cylindrical wall placed radially outside of them, and the inside of the compressor is isolated from the outside air. Therefore the sealing ability at the front coupling surface and the rear coupling surface has been improved. The seal can prevent the high pressure refrigerant in the cylinder bore and the discharge chamber from leaking through the front coupling surface and the rear coupling surface, when the high pressure refrigerant compressed in the cylinder bore is discharged to the discharge chamber according to the reciprocating motion of the pistons in the cylinder bores by driving the drive shaft. As explained above, the degradation of the performance of the compressor due to the leakage of the high pressure refrigerant through the front coupling surface and the rear coupling surface, that is, out of the compressor through the end face of the cylinder block, can be avoided.

Furthermore, since the above-mentioned cylindrical wall is attached at least to one of the front housing and the rear housing, it is not necessary to provide a part such as a cylindrical wall, separately, to enclose the front coupling surface and the rear coupling surface, leading to an advantage in cost and in simplicity of structure.

Still furthermore, even if such parts as O-rings are removed, which serve to seal the front coupling surface and the rear coupling surface, the high pressure refrigerant can be prevented from leaking out of the compressor, and the cost can also be reduced and the structure can be simplified due to a reduction in the number of parts.

The piston type compressor in the second embodiment of the present invention comprises a cylinder block which has a cylinder bore formed therein, a rear end face and a front end face, a front housing that has a rear end face, supports a drive shaft, while allowing a rotational motion, and is coupled to a front of the cylinder block at a front coupling surface, which is formed by the rear end face of the front housing and the front end face of the cylinder block and has an outer periphery, a rear housing that has a front end face forms at least a discharge chamber internally and is coupled to a rear of the cylinder block at a rear coupling surface, which is formed by the front end face of the rear housing and the rear end face of the cylinder block and has an outer periphery, and a motor housing placed in front of the front housing and equipped internally with a motor mechanism that drives the drive shaft, wherein: refrigerant is compressed and the high pressure refrigerant is discharged to the discharge chamber by the reciprocating motion of pistons in the cylinder bores by driving the drive shaft; the motor housing includes a cylindrical wall that is placed radially outside and encloses the front coupling surface and the rear coupling surface; and a cover member, which is placed behind a rear of the rear housing, and the front end face of which comes into contact with the rear end face of the rear housing, is coupled to a rear end of the cylindrical wall.

In this compressor, the front coupling surface and the rear coupling surface are enclosed by the cylindrical wall of the motor housing, and the inside of the compressor is isolated from the outside air, thus the sealing ability at the front coupling surface and the rear coupling surface is improved. At the same time, a hermetic space is formed internally by coupling the cylindrical wall of the motor housing to the cover member. Therefore the seal can prevent the high pressure refrigerant in the cylinder bores and the discharge chamber from leaking through the front coupling surface and the rear coupling surface, when the high pressure refrigerant compressed in the cylinder bores is discharged to the discharge chamber by the reciprocating motion of the pistons in the cylinder bores by driving the drive shaft by the motor mechanism. Moreover, even if the high pressure refrigerant leaks through the front coupling surface and the rear coupling surface, the leaked high pressure refrigerant remains in the hermetic space formed by coupling the cylindrical wall to the cover member and does not leak out of the compressor. As explained above, the degradation of the performance of the compressor due to the leakage of the high pressure refrigerant out of the compressor through the front coupling surface and the rear coupling surface can be avoided.

Furthermore, since the above-mentioned cylindrical wall is attached to the motor housing, it is not necessary to provide a part such as a cylindrical wall separately to enclose the front coupling surface and the rear coupling surface, leading to advantages in cost and in simplicity of structure.

Still furthermore, since the hermetic space is formed internally by coupling the cylindrical wall of the motor housing to the cover member, the reliability of the seal in the compressor can be improved by improving the reliability of the seal between the coupling surfaces of the cylindrical wall and the cover member.

Moreover, even if such parts as O-rings, which serve to seal the front coupling surface and the rear coupling surface, are removed, the high pressure refrigerant can be prevented from leaking out of the compressor, and the cost can be reduced and the structure can be simplified due to the reduction in the number of the parts.

Moreover, since the front end face of the cover member comes into contact with the rear end face of the rear housing, the cover member can securely prevent the rear housing, which receives the high pressure in the discharge chamber, from detaching from the cylinder block. Therefore, a higher quality seal at the rear coupling surface can be maintained by maintaining a higher tightness, compared with the case when the front end face of the cover member does not come into contact with the rear end face of the rear housing.

The present invention may be more fully understood from the description of the preferred embodiments of the invention set forth below, together with the accompanying drawings.

DESCRIPTION OF THE PREFERRED EMBODIMENTS

The embodiments of the present invention will be described in detail below with reference to the accompanying drawings.

(First Embodiment)

The first embodiment is described below.

Figure 1:
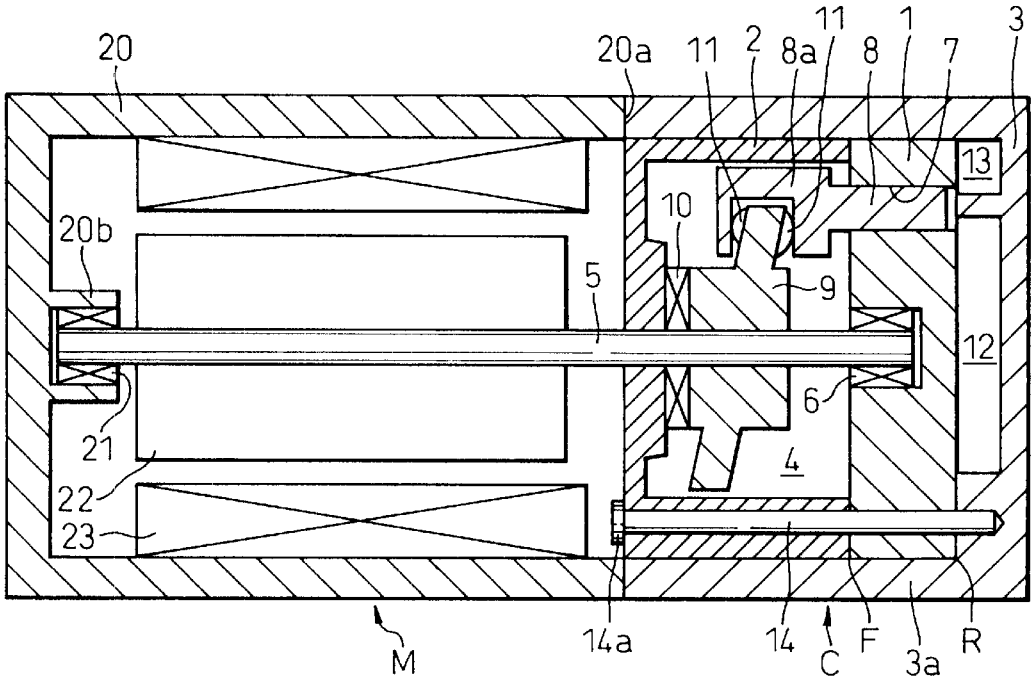
FIG. 1 is a longitudinal sectional view of the compressor in the first embodiment.

The compressor 1 shown in FIG. 1 is used for an air conditioner in a vehicle, more particularly for an air conditioner with supercritical cycle. Such an air conditioner comprises a compressor, a gas cooler used as a heat exchanger for heat dissipation, an expansion valve as a throttle means, an evaporator used as a heat exchanger for heat absorption, and a closed circuit in which accumulators used as a gas-liquid separator are connected in series, though these are not shown here with the exception of the compressor, and the air conditioner operates with the discharge pressure of the compressor (pressure of the high-pressure side of the circuit) being a supercritical pressure of the refrigerant that circulates the circuit. Carbon dioxide ($Co_2$) is used as refrigerant. In addition to carbon dioxide ($CO_2$), ethylene ($C_2H_4$), diborane ($B_2H_6$), ethane ($C_2H_6$), nitric oxide etc. can be used as refrigerant.

This compressor is equipped with a compression mechanism C at the rear and a motor mechanism M in the front.

In the compression mechanism C, the front housing 2 is coupled to the front end side of the cylinder block 1, and the rear housing 3 is coupled to the rear end side of the cylinder block 1 with a valve plate (not shown) being interposed therebetween. A crank chamber 4, which is formed by the cylinder block 1 and the front housing 2, contains a drive shaft 5, the front end of which extends from the front housing 2 to the motor mechanism M side. The rear end of the drive shaft 5 is rotatably supported by the cylinder block 1 through a radial bearing 6 provided therebetween. Moreover, plural cylinder bores 7 are bored in the cylinder block 1 arranged around the drive shaft 5, and each cylinder bore 7 contains a single-headed piston 8 equipped with a neck portion 8*a,* allowing a reciprocating motion.

In the crank chamber 4, a swash plate 9 is attached to the drive shaft 5 so as to rotate synchronously, and a thrust bearing 10 is put between the swash plate 9 and the front housing 2. A pair of shoes 11 is put between the swash plate 9 and the neck portion 8*a* of the piston 8, one in the front and the other at the rear of the swash plate. A rotational motion of the swash plate 9 with a fixed inclination angle with respect to the drive shaft 5, which is supported so as to rotate synchronously, is converted into a longitudinal reciprocating motion of the piston 8 via the shoes 11, and the piston 8 reciprocates in the cylinder bore 7.

In the rear housing 3, a discharge chamber 12 is formed in the center and a suction chamber 13 is formed outside the discharge chamber 12. Each compression chamber formed between the end face of each piston 8 and each cylinder bore 7 communicates with the discharge chamber 12 via each discharge port (not shown) formed through the valve plate. And each discharge port is designed so that it can be opened and closed by a discharge valve (not shown) in the discharge chamber 12 side. Each compression chamber communicates with the suction chamber 13 via each suction port (not shown) formed through the valve plate, and each suction port is designed so that it can be opened and closed by a suction valve (not shown) at each compression chamber side. The suction chamber 13 is connected to an accumulator, which is a constituent of the refrigerating circuit of the air conditioner, by means of piping, and the discharge chamber 12 is connected to a gas cooler, which is also a constituent of the refrigerating circuit of the air conditioner, by means of piping.

In the compression mechanism C, the rear housing 3 integrally includes a cylindrical wall 3*a,* which is placed radially outside and encloses the front coupling surface F, which is formed by a rear end face of the front housing 2 and a front end face of the cylinder block 1, and the rear coupling surface R, which is formed by a front end face of the rear housing 3 and a rear end face of the cylinder block 1. The cylindrical wall 3*a* extends from the rear housing 3 to the front end face of the front housing 2, and the cylinder block 1 and the front housing 2 are inserted and mounted into the inner surface of the cylindrical wall 3*a.*

In the compression mechanism C, the front housing 2, the cylinder block 1, and the rear housing 3 are tightened together by bolts 14, equipped with head portions 14*a,* to the front housing 2 side in the motor housing 20, which is explained later.

Furthermore, in the compressor mechanism C, no O-ring is interposed as a sealing member between the front coupling surface F and the rear coupling surface R.

On the other hand, in the motor mechanism M equipped with a motor system that drives the drive shaft 5, a motor housing 20, the rear side of which (compression mechanism C side) is open, is placed in front of the front housing 2. The open end (rear end face) 20*a* of the motor housing 20 is welded to the front end face of the cylindrical wall 3*a* that encloses the front coupling surface F described above and the rear coupling surface R described above so as to be placed radially outside at the position except the vicinity of the circumferences of the front coupling surface F and the rear coupling surface R. The rear housing 3 and the motor housing 20, thus form a hermetic space internally.

The front end of the drive shaft 5, which extends from the compression mechanism C into the motor housing 20, is supported by the inner surface of a bearing boss 20*b* that is formed integrally with the inner wall of the front end of the motor housing 20, at the center, via a radial bearing 21 that allows the drive shaft 5 to rotate. A rotor 22 is mounted onto the drive shaft 5 in the motor housing 20. Corresponding to the rotor 22, a coil 23 is fixed at the specified place on the inner surface of the motor housing 20. The coil 23 is connected to an external DC power supply (not shown) by a lead (not shown), and the motor mechanism M is driven by the DC power supply.

In the compressor, the structure of which is explained as above, when the DC power supply drives the motor mechanism M, the rotor 22 rotates and the drive shaft 5 is rotated. The rotational motion of the drive shaft 5 causes the swash plate 9 to rotate with a determined and fixed inclination angle, synchronizing with the drive shaft 5, and the piston 8 is linearly reciprocated in the cylinder bore 7 via the pair of shoes 11. This causes the refrigerant at low pressure that has been fed back from the accumulator to the suction chamber 13 to be drawn into the compression chamber of the cylinder bore 7 and, after being compressed, the refrigerant is discharged to the discharge chamber 12 at high pressure. The high pressure refrigerant discharged to the discharge chamber 12 is then sent to the gas cooler.

At this time, in the air conditioner according to the present embodiment that uses $CO_2$ as refrigerant, the compressor discharges the discharge gas at the supercritical pressure of the refrigerant (about 10 MPa). In this case, because of the extremely high discharge pressure, the high pressure refrigerant may easily leak through the front coupling surface F and the rear coupling surface R. Moreover, since the permeability of the $CO_2$refrigerant through rubber is high, it is difficult to maintain the sufficient sealing ability even though O-rings are used.

In the compression mechanism C of the compressor in the present embodiment, however, since the front coupling surface F and the rear coupling surface R are enclosed by the cylindrical wall 3*a* that is attached integrally to the rear housing 3 so as to stay radially outside the front coupling surface F and the rear coupling surface R, and the inside of the compressor is isolated from the outside air, the sealing ability at the front coupling surface F and the rear coupling surface R is improved. Moreover, since the front end face of the cylindrical wall 3*a* is coupled to the rear end face 20*a* of the motor housing 20, in a condition that the front coupling surface F and the rear coupling surface R are enclosed by the cylindrical wall 3*a,* a hermetic space is formed internally. Therefore, even if the high pressure refrigerant in the compression chamber of the cylinder bore 7 and the discharge chamber 12 may leak through the front coupling surface F and the rear coupling surface R, the leaked high pressure refrigerant remains in the above-mentioned hermetic space and does not leak out of the compressor. This, therefore, can prevent the high pressure refrigerant in the compression chamber and the discharge chamber 12 from leaking out of the compressor through the front coupling surface F and the rear coupling surface R, when the high pressure refrigerant compressed in the compression chamber of the cylinder bore 7 is discharged to the discharge chamber 12. Therefore, this compressor, even if $CO_2$ is used as refrigerant, can prevent the degradation of the performance of the compressor due to the leakage of the high pressure refrigerant to the outside of the compressor through the front coupling surface F and the rear coupling surface R, in other words, through the end face of the cylinder block 1.

Furthermore, because the above-mentioned cylindrical wall 3*a* is attached to the rear housing 3 integrally, it is not necessary to provide a part such as a cylindrical wall separately to enclose the front coupling surface F and the rear coupling surface R, and also because a hermetic space is formed internally by coupling the cylindrical wall 3*a* integral with the rear housing 3 to the motor housing 20, it is also not necessary to provide a part such as a cover member separately to improve the sealing ability in the compressor. Therefore, the compressor of this type has advantage in cost and in simplicity of structure, and the reliability of seal thereof can be improved by improving the sealing reliability at the coupled surface between the cylindrical wall 3*a* and the motor housing 20.

In addition, such parts as O-rings that can maintain the sealing ability at the front coupling surface F and the rear coupling surface R can be omitted, and such a reduction in the number of the parts will lead to a reduction in cost and to simplicity in structure.

Still furthermore, since the front housing 2, the cylinder block 1, and the rear housing 3 are tightened together by the bolts 14 equipped with the head portions 14*a* to the front housing 2 side in the motor housing 20, even if the high pressure refrigerant leaks through the front coupling surface F and the rear coupling surface R via the clearance between the bolt 14 and the bolt hole, the leaked high pressure refrigerant remains in the hermetic space formed by the motor housing 20 and the rear housing 3 and does not leak out of the compressor. Therefore, even if the washer used to keep the sealing ability of the clearance between the bolt 14 and the bolt hole is omitted, a problem of the leakage of high pressure refrigerant to the outside of the compressor dose not occur and, instead, the cost can be reduced by omitting the seal washers.

(Second Embodiment)

Figure 2:
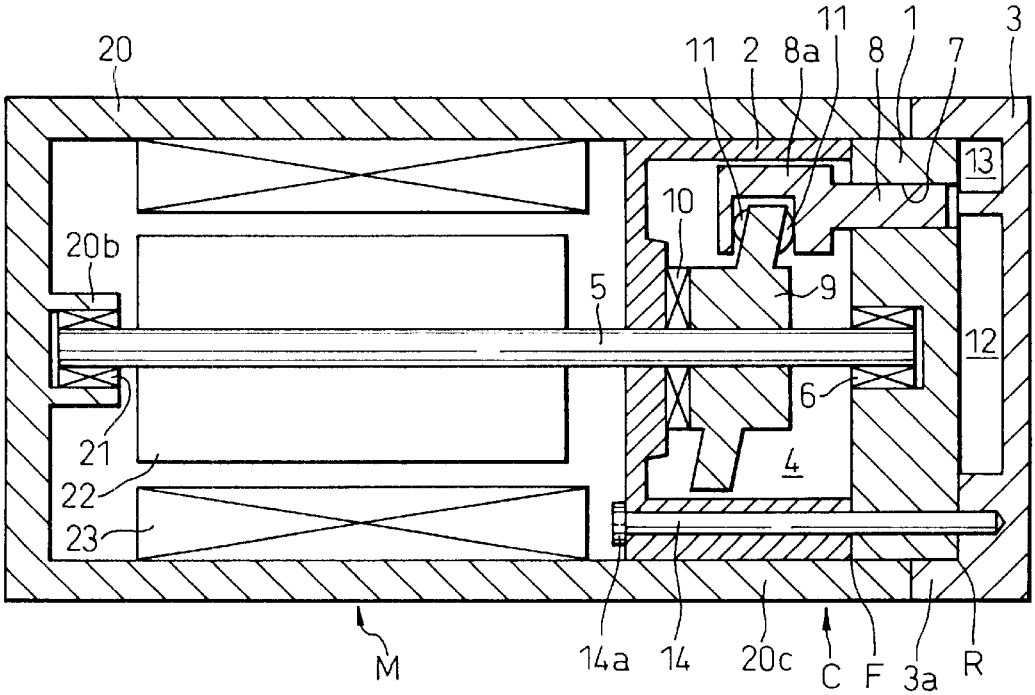
FIG. 2 is a longitudinal sectional view of the compressor in the second embodiment.

The second embodiment shown in FIG.2 is described below.

In this compressor, the rear housing 3 integrally includes the cylindrical wall 3*a,* which is placed radially outside and encloses the rear coupling surface R, and which extends to the vicinity of the center of the cylinder block 1, and at the same time, the motor housing 20 also integrally includes the cylindrical wall 20*c,* which is placed radially outside and encloses the front coupling surface F, and which extends to the vicinity of the center of the cylinder block 1. The front end face of the cylindrical wall 3*a* of the rear housing 3 is welded to the rear end face of the cylindrical wall 20c of the motor housing 20 in a condition that the cylindrical wall 3*a* of the rear housing 3 encloses the rear coupling surface R and the cylindrical wall 20*c* of the motor housing 20 encloses the front coupling surface F, and thus a hermetic space is formed internally.

Other structures are the same as that in the first embodiment mentioned above.

Therefore, the compressor of this type will provide the same effect as that of the first embodiment mentioned above.

(Third Embodiment)

Figure 3:
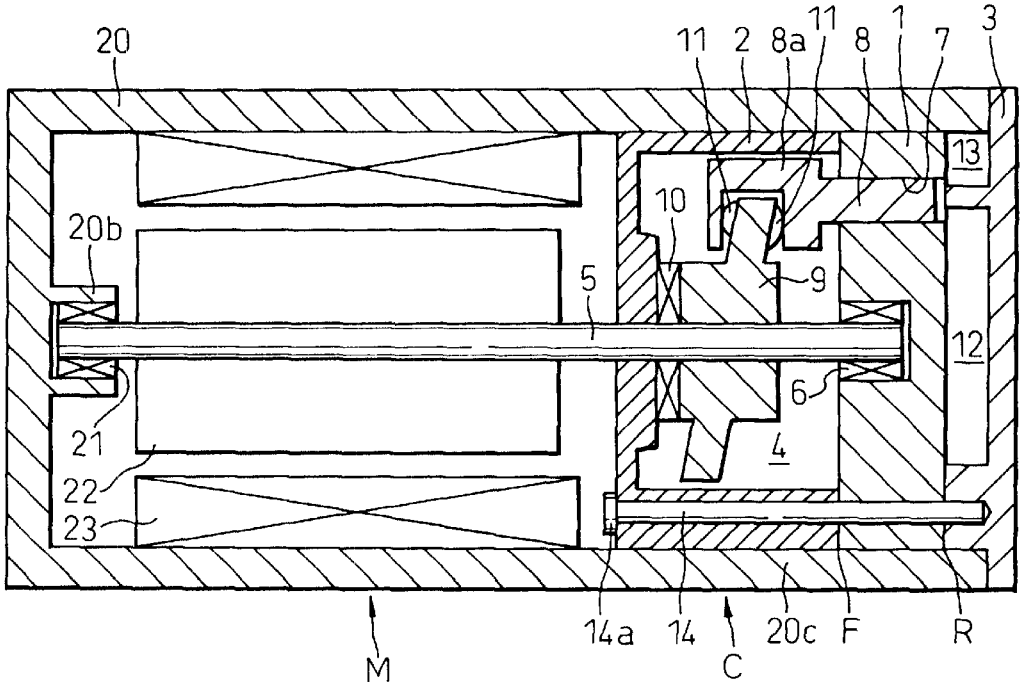
FIG. 3 is a longitudinal sectional view of the compressor in the third embodiment.

The third embodiment shown in FIG.3 is described below.

In this compressor, the motor housing 20 integrally includes the cylindrical wall 20*c,* which is placed radially outside and encloses the front coupling surface F and the rear coupling surface R, and which extends as far as to the rear housing 3. The rear end face of the cylindrical wall 20*c* of the motor housing 20 is welded to the front face of the rear housing 3 in a condition that the cylindrical wall 20*c* of the motor housing 20 encloses the front coupling surface F and the rear coupling surface R, and a hermetic space is formed internally.

Other structures are the same as that of the first embodiment mentioned above.

Therefore, the compressor of this type will provide the same effect as that of the first embodiment mentioned above.

Though an example, in which the rear end face of the cylindrical wall 20*c* of the motor housing 20 is coupled to the front face of the rear housing 3, is provided in the third embodiment, it is possible to couple the inner surface of the rear end of the cylindrical wall 20*c* to the outer surface of the rear housing 3.

(Fourth Embodiment)

Figure 4:
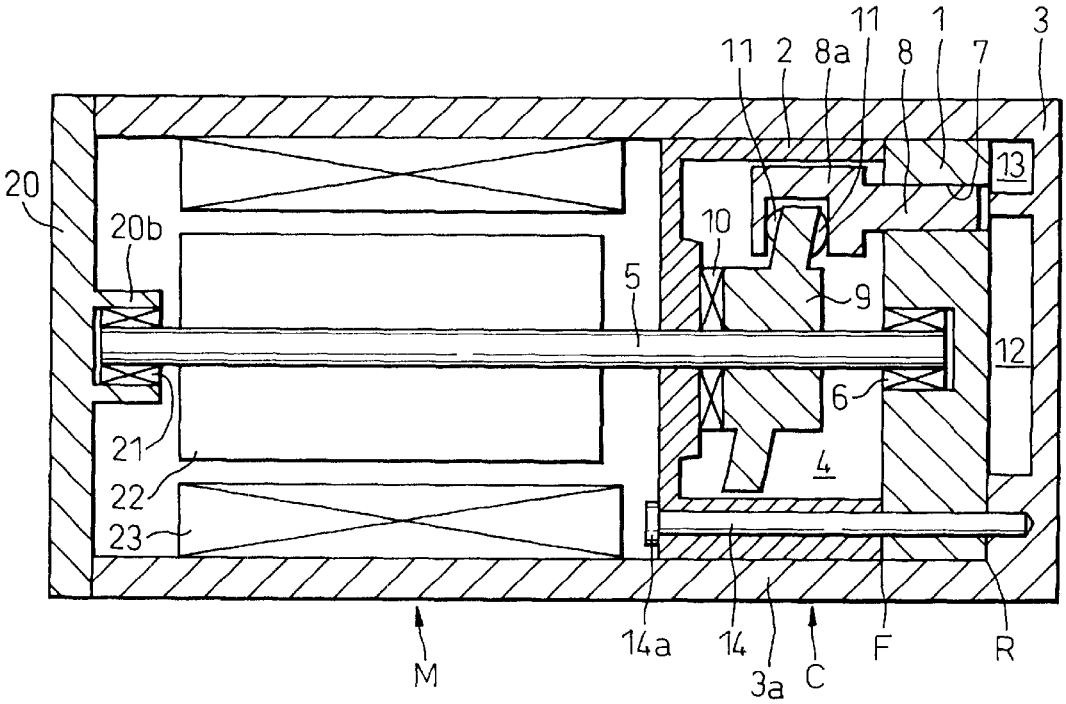
FIG. 4 is a longitudinal sectional view of the compressor in the fourth embodiment.

The fourth embodiment shown in FIG.4 is described below.

In this compressor, the motor housing 20 has a plate-like figure and the rear housing 3 integrally includes the cylindrical wall 3*a,* which is placed radially outside and encloses the front coupling surface F and the rear coupling surface R, and which extends as far as the motor housing 20. The front end face of the cylindrical wall 3*a* of the rear housing 3 is welded to the rear face of the motor housing 20 in a condition that the cylindrical wall 3*a* of the rear housing 3 encloses the front coupling surface F and the rear coupling surface R, and a hermetic space is formed internally. The coil 23, which is a constituent of the motor mechanism M, is fixed to the inner surface of the cylindrical wall 3*a*.

Other structures are the same as that of the first embodiment mentioned above.

Therefore, the compressor of this type will provide the same effect as that of the first embodiment mentioned above.

Though an example, in which the front end face of the cylindrical wall 3*a* of the rear housing 3 is coupled to the rear face of the motor housing 20, is provided in the fourth embodiment, it is possible to couple the inner surface of the front end of the cylindrical wall 3*a* to the outer surface of the motor housing 20.

(Fifth Embodiment)

Figure 5:
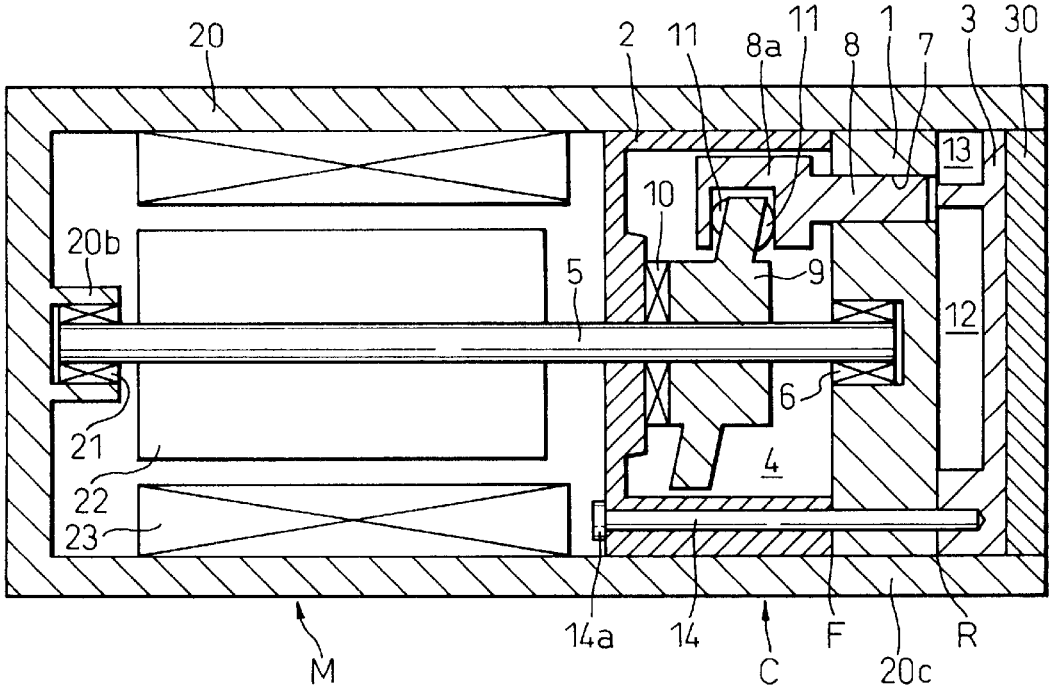
FIG. 5 is a longitudinal sectional view of the compressor in the fifth embodiment.
Figure 6:
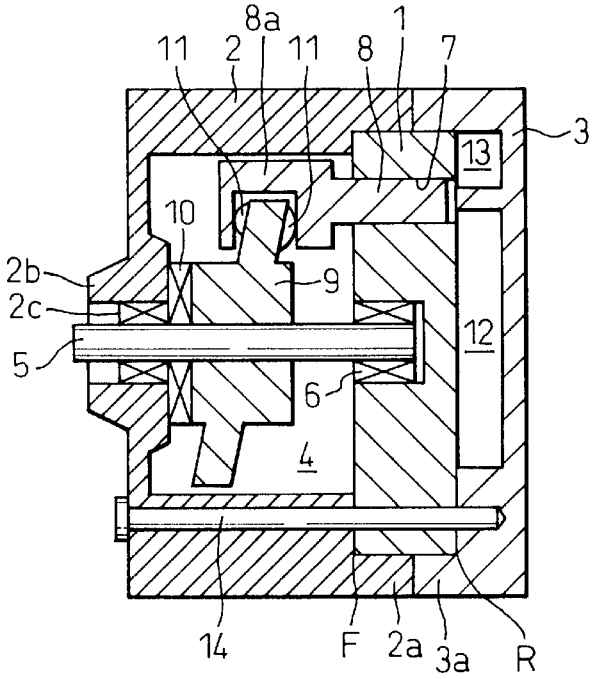
FIG. 6 is a longitudinal sectional view of the compressor in the sixth embodiment.

The fifth embodiment shown in FIG.5 is described below.

In this compressor, the motor housing 20 integrally includes the cylindrical wall 20*c,* which is placed radially outside and encloses the front coupling surface F and the rear coupling surface R, and which extends as far as to the rear of the rear housing 3. The outer surface of the cover member 30, which is a rigid body, placed at the rear of the rear housing 3, and the entire front end face of which comes into contact with the rear end face of the rear housing 3, is welded to the inner surface of the rear end of the cylindrical wall 20*c*. The front housing 2, the cylinder block 1, and the rear housing 3 are inserted into and mounted on the inner surface of the cylindrical wall 20*c* of the motor housing 20.

Other structures are the same as that of the first embodiment mentioned above.

In this compressor, since the front coupling surface F and the rear coupling surface R are enclosed by the cylindrical wall 20*c* of the motor housing 20, the inside of the compressor is isolated from the outside air, and the sealing ability at the front coupling surface F and the rear coupling surface R is improved, and at the same time, a hermetic space is formed internally by coupling the cylindrical wall 20*c* of the motor housing 20 to the cover member 30. Therefore, when the high pressure refrigerant compressed in the compression chamber of the cylinder bore 7 is discharged to the discharge chamber 12 by the reciprocating motion of the piston 8 in the cylinder bore 7 by driving the drive shaft 5 by the motor mechanism M, it is possible to prevent the high pressure refrigerant in the compression chamber of the cylinder bore 7 and in the discharge chamber 12 from leaking through the front coupling surface F and the rear coupling surface R. And even if the high pressure refrigerant leaks through the front coupling surface F and the rear coupling surface R, the leaked high pressure refrigerant remains in the hermetic space formed by the cylindrical wall 20*c* of the motor housing 20 and the cover member 30 and does not leak out of the compressor. Therefore, the degradation of the performance of the compressor due to leakage of the high pressure refrigerant out of the compressor through the front coupling surface F and the rear coupling surface R can be prevented.

Furthermore, since the above-mentioned cylindrical wall 20*c* is attached integrally to the motor housing 20, it is not necessary to provide a part such as a cylindrical wall separately to enclose the front coupling surface F and the rear coupling surface R, leading to an advantage in cost and in simplicity of structure.

On the other hand, since a hermetic space is formed internally by coupling the cylindrical wall 20*c* of the motor housing 20 to the cover member 30, the reliability of the seal in the compressor can be improved by improving the reliability to seal the coupling surface between the cylindrical wall 20*c* and the cover member 30.

Still furthermore, such parts as O-rings that serve to seal the front coupling surface F and the rear coupling surface R can be omitted, and such a reduction in the number of parts may lead to a reduction in cost and to simplicity in structure.

In addition, since the entire front end face of the cover member 30 comes into contact with the rear end face of the rear housing 3, the entire part of the cover member 30 can prevent securely the rear housing 3 that receives the high pressure from the discharge chamber 12 from detaching from the cylinder block 1. Moreover, the cover member 30 is coupled to the inside of the cylindrical wall 20*c,* and the force (separating force) to separate the cover member 30 from the cylindrical wall 20*c* works as a shearing force between the inner surface of the cylindrical wall 20*c* and the outer surface of the cover member 30. Therefore, the cylindrical wall 20*c* and the cover member 30 are forced together, and the coupling strength is stronger than in the case when the rear end face of cylindrical wall 20*c* is coupled to the front end face of the cover member 30 to work the separating force as a tensile force therebetween. The rigid body of the cover member 30 also prevents deformation of itself. Therefore, the entire part of the cover member 30 can prevent securely the rear housing 3 that receives the high pressure from the discharge chamber 12 from detaching from the cylinder block 1. This realizes high tightness and enables a sufficient sealing ability at the rear coupling surface R.

Though an example, in which the inner surface of the cylindrical wall 20*c* of the motor housing 20 is coupled to the outer surface of the cover member 30, is provided in the fifth embodiment, it is possible to couple the rear end face of the cylindrical wall 20*c* to the front end face of the cover member 30.

(Sixth Embodiment)

The sixth embodiment is explained below.

In this compressor, the rear housing 3 integrally includes the cylindrical wall 3*a,* which is placed radially outside and encloses the rear coupling surface R, and which extends to the vicinity to the center of the cylinder block 1, and at the same time, the front housing 2 integrally includes the cylindrical wall 2*a,* which is placed radially outside and encloses the front coupling surface F, and which extends to the vicinity to the center of the cylinder block 1. The front end face of the cylindrical wall 3*a* of the rear housing 3 is welded to the rear end face of the cylindrical wall 2*a* of the front housing 2, in a condition that the cylindrical wall 3*a* of the rear housing 3 encloses the rear coupling surface R, and the cylindrical wall 2*a* of the front housing 2 encloses the front coupling surface R, and a hermetic space is thus formed internally.

The front housing 2 is equipped with a boss 2*b* in the center of the front end wall, and the front end of the drive shaft 5 is supported and is allowed to rotate by a radial bearing 2*c* that is provided between the boss 2*b* and the drive shaft 5.

In this compressor, the drive force of the engine is used as a drive source instead of the motor mechanism M, and the drive force of the engine is transferred to the drive shaft 5 via an electromagnetic clutch (not shown) that is connected to the front end of the drive shaft 5.

Other structures are the same as that of the first embodiment mentioned above.

Therefore, the compressor of this type will provide the same effect as that of the first embodiment mentioned above.

Though an example, in which the cylindrical wall 3*a* of the rear housing 3 encloses the rear coupling surface R, and at the same time, the cylindrical wall 2*a* of the front housing 2 encloses the front coupling surface F, is provided in the sixth embodiment, it is possible that only the cylindrical wall 3*a* of the rear housing 3 encloses both the front coupling surface F and the rear coupling surface R, and the front end of the cylindrical wall 3*a* is coupled to the front housing 2, or only the cylindrical wall 2*a* of the front housing 2 encloses both the front coupling surface F and the rear coupling surface R, and the rear end of the cylindrical wall 2*a* is coupled to the rear housing 3.

Furthermore, though examples of an air conditioner with a supercritical cycle that uses carbon dioxide as refrigerant are provided in the first through the sixth embodiments, it is apparent that the compressor of the present invention can be applied to an air conditioner with subcritical cycle that uses chlorofluorocarbon as refrigerant.

Still furthermore, though in the first through the sixth embodiments described above examples of a compressor of fixed displacement type in which a single head piston is connected to a swash plate by a pair of shoes, one in front and the other at the rear of the swash plate, it is also apparently possible that a double-headed piston can be used, or the single headed piston is connected to a swash plate via a rod, or a compressor of variable displacement type can be used.

While the invention has been described by the reference to specific embodiments chosen for the purposes of illustration, it should be apparent that numerous modifications could be made thereto by those skilled in the art without departing from the basic concept and scope of the invention.

What is claimed is:

1. A piston type compressor comprising:

a cylinder block having cylinder bores formed therein, a rear end face and a front end face;

a front housing having a rear end face and coupled to a front of the cylinder block at a front coupling surface, said front coupling surface formed by the rear end face of the front housing and the front end face of the cylinder block, and having an outer periphery;

a rear housing having a front end face, coupled to the rear of the cylinder block at a rear coupling surface formed by the front end face of the rear housing and the rear end face of the cylinder block, having an outer periphery, and forming at least a discharge chamber internally;

a drive shaft rotatably supported by the front housing;

pistons reciprocatingly arranged in said cylinder bores; and a swash plate rotatably arranged to connect pistons with said drive shaft; wherein:

a high pressure refrigerant is discharged to the discharge chamber after the refrigerant is compressed by a reciprocating motion of pistons by driving the drive shaft; and at least one of the front housing and the rear housing includes a cylindrical wall placed radially outside and enclosing said front coupling surface and the rear coupling surface.

2. A piston type compressor as set forth in claim 1, wherein:

in front of the front housing, there is a motor housing equipped with a motor mechanism that drives the drive shaft;

at least one of the motor housing and the rear housing includes a cylindrical wall placed radially outside and enclosing the front coupling surface and the rear coupling surface; and said motor housing is coupled to the rear housing in a condition that the front coupling surface and the rear coupling surface are enclosed by the cylindrical wall.

3. A piston type compressor as set forth in claim 2, wherein the front housing, the cylinder block, and the rear housing are tightened together by bolts equipped with head portions at the front housing side in the motor housing.

4. A piston type compressor as set forth in claim 1, wherein: the piston is a single head type; and said piston is driven by a swash plate supported with a determined inclination angle with respect to the drive shaft, to be allowed a rotational motion.

5. A piston type compressor as set forth in claim 4, wherein a pair of shoes, one in front and the other at the rear of the swash plate, is provided between the swash plate and the piston.

6. A piston type compressor as set forth in claim 1, wherein the discharge gas is discharged at the supercritical pressure of the refrigerant.

7. A piston type compressor as set forth in claim 6, wherein carbon dioxide is used as refrigerant.

8. A piston type compressor comprising:

a cylinder block having cylinder bores formed therein, a rear end face and a front end face;

a front housing having a rear end face and coupled to the front of the cylinder block at a front coupling surface formed by the rear end face of the front housing and the front end face of the cylinder block, and having an outer periphery;

a rear housing having a front end face, coupled to the rear of the cylinder block at a rear coupling surface formed by the front end face of the rear housing and the rear end face of the cylinder block, having an outer periphery, and forming at least a discharge chamber internally;

a drive shaft rotatably supported by the front housing;

pistons reciprocatingly arranged in said cylinder bores;

a swash plate rotatably arranged to connect pistons with said drive shaft; and a motor housing placed in front of the front housing, equipped internally with a motor mechanism driving the drive shaft, wherein:

a high pressure refrigerant is discharged to the discharge chamber after the refrigerant is compressed by a reciprocating motion of pistons by driving the drive shaft;

the motor housing includes a cylindrical wall placed radially outside and enclosing the front coupling surface and the rear coupling surface; and a cover member placed behind the rear of the rear housing, and the front end face of which comes in contact with the rear end face of the rear housing, is coupled to the rear end of the cylindrical wall.

9. A piston type compressor as set forth in claim 8, wherein the front housing, the cylinder block, and the rear housing are tightened together by bolts equipped with head portions at the front housing side in the motor housing.

10. A piston type compressor as set forth in claim 8, wherein: the piston is a single head type; and said piston is driven by a swash plate supported with a determined inclination angle with respect to the drive shaft, to be allowed a rotational motion.

11. A piston type compressor as set forth in claim 10, wherein a pair of shoes, one in front and the other at the rear of the swash plate, is provided between the swash plate and the piston.

12. A piston type compressor as set forth in claim 8, wherein the discharge gas is discharged at the supercritical pressure of the refrigerant.

13. A piston type compressor as set forth in claim 12, wherein carbon dioxide is used as refrigerant.

* * * * *